US006219846B1

(12) United States Patent
Toole

(10) Patent No.: US 6,219,846 B1
(45) Date of Patent: Apr. 24, 2001

(54) BIB ASSEMBLY WITH ATTACHED TOWELETTE AND TWIST TIE MEMBER

(76) Inventor: William D. Toole, 6146 W. 82nd St., Burbank, IL (US) 60459

( * ) Notice: Subject to any disclaimer, the term of this patent is extended or adjusted under 35 U.S.C. 154(b) by 0 days.

(21) Appl. No.: 09/327,414

(22) Filed: Jun. 7, 1999

Related U.S. Application Data

(60) Provisional application No. 60/088,692, filed on Jun. 9, 1998.

(51) Int. Cl.[7] ..... A41B 13/10
(52) U.S. Cl. ..... 2/49.2; 2/49.4; 2/52
(58) Field of Search ..... 2/49.1, 49.2, 49.3, 2/49.4, 49.5, 50, 51, 52, 48, 46, 102, 104

(56) References Cited

U.S. PATENT DOCUMENTS

| | | | | |
|---|---|---|---|---|
| 2,423,489 | | 7/1947 | Dunn | 2/49 |
| 2,423,581 | * | 7/1947 | Clark | 2/48 |
| 2,430,941 | | 11/1947 | Long | 2/49 |
| 2,563,420 | * | 8/1951 | Roe | 2/48 |
| 2,651,039 | * | 9/1953 | Tonkens et al. | 2/49.2 |
| 2,653,324 | * | 9/1953 | McMahon | 2/52 |
| 2,674,738 | * | 4/1954 | Mehlos | 2/48 |
| 2,830,297 | * | 4/1958 | Sabee | 2/49.4 |
| 2,859,446 | | 11/1958 | Older | 2/52 |
| 3,057,467 | * | 10/1962 | Williams | 206/46 |
| 3,801,985 | * | 4/1974 | Batt | 2/51 |
| 4,458,364 | * | 7/1984 | Fenninger et al. | 2/50 |
| 4,779,288 | | 10/1988 | Mack | 2/49 R |
| 4,924,528 | * | 5/1990 | Trombetti-dickens | 2/46 |
| 5,666,665 | | 9/1997 | Morgado | 2/49.1 |
| 5,682,609 | | 11/1997 | Ayo | 2/49.2 |
| 5,875,490 | * | 3/1999 | Woodard et al. | 2/48 |
| 5,960,471 | * | 10/1999 | Burton | 2/49.2 |
| 6,000,056 | * | 12/1999 | Brady et al. | 2/49.1 |

* cited by examiner

*Primary Examiner*—Amy B. Vanatta
(74) *Attorney, Agent, or Firm*—Flanagan & Flanagan; John R. Flanagan; John K. Flanagan

(57) ABSTRACT

A bib assembly includes a first body comprised of a substantially flexible sheet-like material in a substantially unfolded condition, a twist tie member connected to an upper edge portion of the first body for removably securing the first body to a neck of a user such that the first body covers a front portion of the user, a second body including a folded flexible sheet of material separate from the first body and adapted to be unfolded for use in wiping debris from hands and around the mouth of the user, and a cuff along a lower edge of the first body for removably receiving and securing the second body to the first body. The second body further includes a rupturable package containing the folded sheet of material of the second body in an interior chamber of the package.

17 Claims, 2 Drawing Sheets

BIB ASSEMBLY WITH ATTACHED TOWELETTE AND TWIST TIE MEMBER

This patent application claims the benefit of provisional application Ser. No. 60/088,692 filed on Jun. 9, 1998.

BACKGROUND OF THE INVENTION

1. Field of the Invention

The present invention generally relates to bibs and, more particularly, is concerned with a bib assembly with an attached towelette and a twist tie member.

2. Description of the Prior Art

A bib may be useful in any of a variety of situations where people commonly eat food. One such common situation is where persons are consuming drinks and snacks while driving or riding in a vehicle. Persons in this situation, particularly, face problems of spillage onto their clothes and surfaces of the vehicle.

One prior art construction of a bib is disclosed in U.S. Pat. No. 2,423,489 to Dunn. The Dunn bib includes a flexible front sheet of absorbent material and a flexible rear sheet of impermeable material attached to the front sheet of absorbent material for preventing liquid absorbed by the front sheet from contacting clothes of the user underneath the bib. The Dunn bib also includes a pair of flexible tie strings affixed at a top of the front and rear sheets for encircling the neck of a user and which are tied together for securing the bib to the user's neck. The Dunn bib further includes a pocket or cuff formed along a bottom of the bib for catching debris dropped down the front of the bib.

Representative examples of other prior art bibs are disclosed in U.S. Pat. No. 2,430,941 to Long, U.S. Pat. No. 2,859,446 to Older, U.S. Pat. No. 4,779,288 to Mack, U.S. Pat. No. 5,666,665 to Morgado and U.S. Pat. No. 5,682,609 to Ayo. While these prior art bibs may be satisfactory in use for the specific purposes for which they were designed, none of them seem to provide a completely effective solution for protecting clothes during the consumption of food and beverages. One failure of the prior art is that pockets of prior art bibs may not stay sufficiently open to catch debris dropped on the bib due to the lack of any positive structure to ensure such open condition. Another failure of the prior art is that in some situations, such as in a vehicle, it may be difficult and cumbersome for the user to tie the strings of the bib around his or her neck.

Consequently, a need remains for a bib construction which provides a more effective solution to the aforementioned problems of the prior art without introducing any new problems in place thereof.

SUMMARY OF THE INVENTION

The present invention provides a bib assembly with an attached towelette and a twist tie member which are designed to satisfy the aforementioned need. The attached towelette of the bib assembly positively holds a bottom cuff of the assembly open to catch debris dropped on the bib. Opposite end portions of the twist tie member of the bib assembly are easily twistable around one another for securing the bib to the neck of a user.

Accordingly, the present invention is directed to a bib assembly which comprises: (a) a first body comprised of a substantially flexible sheet-like material in a substantially unfolded condition; (b) first means for removably securing the first body to a user such that the first body covers a front portion of the user below a mouth of the user for preventing debris dropped from an area adjacent to and including the mouth of the user from contacting the front portion of the user; (c) a second body separate from the first body and including a substantially flexible sheet of material in a substantially folded condition and adapted to be unfolded for use in wiping debris from hands and the area adjacent to and including the mouth of the user; and (d) second means for removably securing the second body to the first body.

More particularly, in a preferred embodiment, the first body has an outer sheet for facing away from the front portion of the user and an inner sheet for facing toward the front portion of the user. The outer sheet is comprised of a substantially flexible absorbent material for absorbing liquid. The inner sheet is comprised of a substantially flexible impermeable material and is attached to the outer sheet for preventing liquid absorbed by the outer sheet from contacting the front portion of the user. In an alternative embodiment, the first body is comprised of a substantially flexible impermeable material. In another alternative embodiment, the first body is comprised of a substantially flexible absorbent material.

The first securing means includes a twist tie member comprised of a substantially twistable material and having a middle portion and opposite end portions. The middle portion is mounted to an upper edge portion of the first body. The middle portion and the opposite end portions are for encircling a neck of the user and the opposite end portions are twistable around one another for securing the twist tie member around the neck of the user and thereby for securing the first body to the user.

The second body further includes a package comprised of a substantially flexible impermeable material and having an interior chamber. The flexible sheet of material of the second body is pre-moistened, folded more than once onto itself, and disposed and sealed within the interior chamber of the package.

The second securing means is a lower edge portion of the first body folded onto itself and sealed to itself at opposite ends such that a cuff and/or a central pocket is formed that receives the second body. The second body can be releasably attached to a front side of the cuff to assist in holding the cuff open along and adjacent to the lower edge portion of the first body to catch debris dropped on the first body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
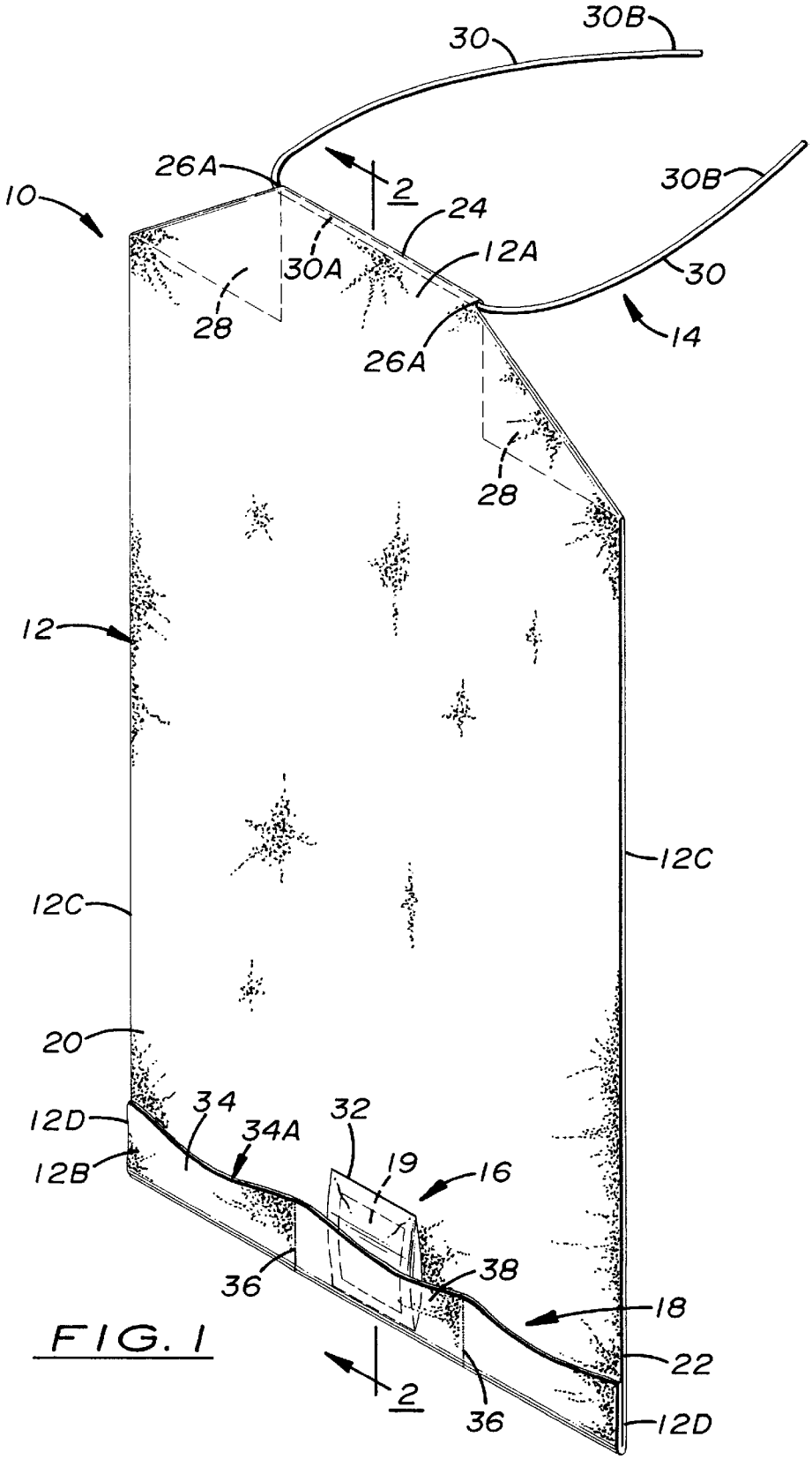
FIG. 1 is a perspective view of a bib assembly of the present invention.

Referring to the drawings and particularly to FIG. 1, there is illustrated a bib assembly, generally designated 10, of the present invention. Basically, the bib assembly 10 includes a first body 12, a first securing means 14, a second body 16 and a second securing means 18. The first body 12 is comprised of a substantially flexible sheet-like material in a substantially unfolded condition. The first securing means 14 is connected to the first body 12 and adapted for removably securing the first body 12 to a neck of a user (not shown) such that the first body 12 covers a front portion of the user below the mouth of the user for preventing debris dropped from the user's mouth from contacting the front portion of the user. The second body 16 is separate from the first body 12 and includes a substantially flexible sheet of material 19 in a substantially folded condition. The sheet of material 19 of the second body 16 is adapted to be unfolded for use in wiping debris from hands and around the mouth of the user. The second securing means 18 is for removably securing the second body 16 to the first body 12.

Figure 2:
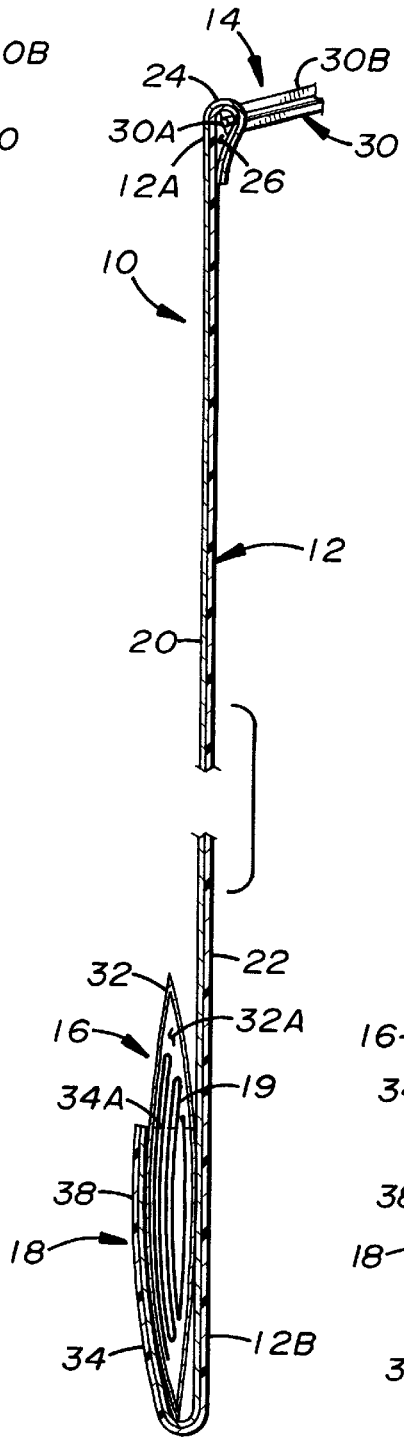
FIG. 2 is a vertical sectional view of the bib assembly taken along line 2—2 of FIG. 1 showing a preferred embodiment of a first body of the bib assembly having an outer sheet of a substantially flexible absorbent material and an inner sheet of a substantially flexible impermeable material.

Referring now to FIGS. 1 to 4, the first body 12 of the bib assembly 10 has a substantially flat sheet-like rectangular configuration, though need not be so limited. The first body 12 may have one of three constructions or any other suitable construction. In a preferred embodiment, the first body 12 has an outer sheet 20 and an inner sheet 22, as shown in FIGS. 1 and 2. Each of the outer and inner sheets 20, 22 has a substantially flat and rectangular configuration, though need not be so limited. The outer and inner sheets 20, 22 can have substantially the same area and thickness. When the bib assembly 10 is worn on the user, the outer sheet 20 faces away from the front portion of the user whereas the inner sheet 22 faces toward the front portion of the user. The outer sheet 20 is comprised of a substantially flexible absorbent material for absorbing liquid whereas the inner sheet 22 is comprised of a substantially flexible impermeable material attached to the outer sheet 20 for preventing liquid absorbed by the outer sheet 20 from contacting the front portion of the user. The outer and inner sheets 20, 22 of the first body 12 may be comprised of material which is disposable or which can be cleaned and reused. As examples, the material of the outer sheet 20 may be a paper towel or the like while the material of the inner sheet 22 may be plastic or the like. The inner sheet 22 is attached to the outer sheet 20 such that the outer sheet 20 and the inner sheet 22 form a single composite sheet or body 12.

Figure 3:
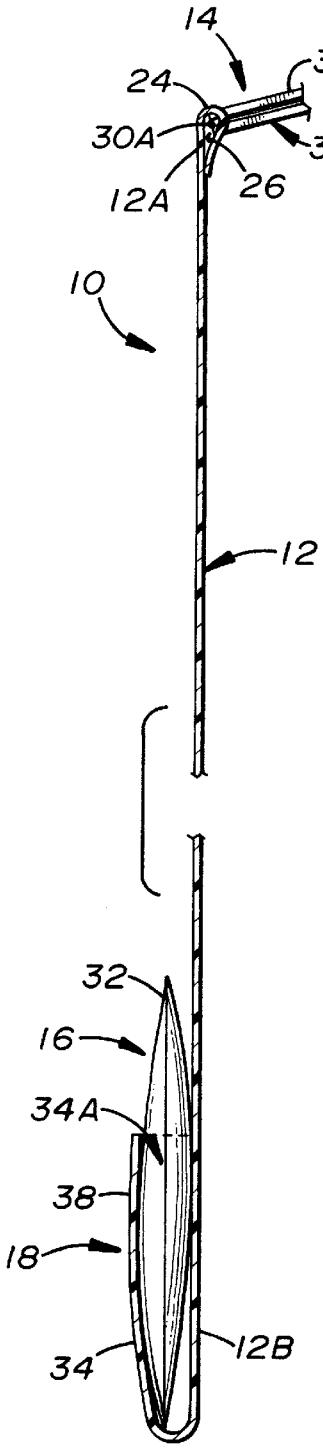
FIG. 3 is another vertical sectional view of the bib assembly similar to that of FIG. 2 but showing an alternative embodiment of the first body comprised of a substantially flexible impermeable material.
Figure 4:
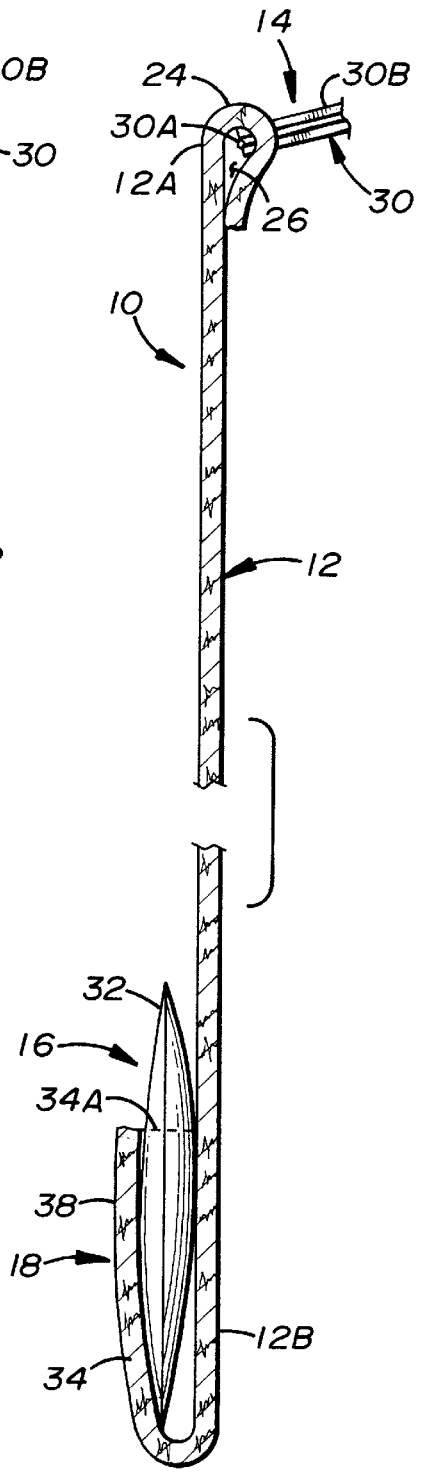
FIG. 4 is still another vertical sectional view of the bib assembly similar to that of FIG. 2 but showing another alternative embodiment of the first body comprised of a substantially flexible absorbent material.

In an alternative embodiment, the first body 12 is comprised of a substantially flexible impermeable material, as shown in FIG. 3, where the first body 12 has a substantially similar configuration and construction as the inner sheet 22 of the first body 12 in the preferred embodiment. The first body 12 in this first alternative embodiment does not absorb liquid and only prevents liquid from contacting the front portion of the user. In another alternative embodiment, the first body 12 is comprised of a substantially flexible absorbent material, as shown in FIG. 4, where the first body 12 has a substantially similar construction as the outer sheet 20 of the first body 12 in the preferred embodiment but has a thickness greater than the combined thicknesses of the outer and inner sheets 20, 22 of the first body 12 in the preferred embodiment. The first body 12 in this second alternative embodiment only absorbs liquid but is sufficiently thick such that the absorbed liquid usually does not penetrate enough to contact the front portion of the user.

More particularly, with respect to all embodiments, the first body 12 has an upper edge portion 12A, a lower edge portion 12B and a pair of opposite side edges 12C. The upper edge portion 12A of the first body 12 is provided with a central section 24 folded onto and attached or sealed by any suitable means to itself so as to define a passageway 26 extending along the upper edge portion 12A of the first body 12 and having open opposite ends 26A. The upper edge portion 12A of the first body 12 adjacent the open opposite ends 26A of the passageway 26 has opposite upper corners 28 folded over and attached or sealed to adjacent portions of the first body 12. The outer and inner sheets 20, 22 of the first body 12 are substantially aligned along their respective sides and edges. The first body 12 on one or both of the outer and inner sheets 20, 22 may have a decoration, logo or the like formed thereon or attached thereto.

The first securing means 14 of the bib assembly 10 preferably takes the form of a twist tie member 30. The twist tie member 30 is comprised of a substantially twistable material such as a covered wire or the like which is deformable and will retain its deformed shape. The covering of the twist tie member 30 may be paper, plastic or any other suitable material. The twist tie member 30 has a middle portion 30A mounted to the first body 12 and a pair of opposite end portions 30B extending from opposite ends of the middle portion 30A. The opposite end portions 30B and the middle portion 30A together are adapted for encircling the user's neck. The opposite end portions 30B are twistable around one another for removably securing the twist tie member 30 around the neck of the user and thereby for securing the first body 12 to the user. The middle portion 30A of the twist tie member 30 is received through and captured within the passageway 26 such that the opposite end portions 30B of the twist tie member 30 extend from the open opposite ends 26A of the passageway 26. The lengths of the opposite end portions 30B are greater than the length of the middle portion 30A. The passageway 26 of the first body 12 has a length which is substantially the same as the length of the middle portion 30A. The first securing means 14 may, alternatively, include an adhesive or clip or any other suitable element or means for securing the first body 12 to the user.

The flexible sheet of material 19 of the second body 16 can be a towelette which per se is conventional. The sheet 19 has a substantially flat rectangular configuration, though need not be so limited. The sheet 19 is comprised of any suitable material and may be pre-moistened. The sheet 19 is much smaller in size than the first body 12 when the sheet 19 is folded. However, when unfolded the size of the sheet 19 of the second body 16 can approach that of the first body 12. The sheet 19 when in the folded condition is folded more than once and, preferably, several times onto itself.

The second body 16 of the bib assembly 10 further includes a package 32. The package 32 is comprised of a substantially flexible impermeable material and defines an interior chamber 32A. The folded sheet of material 19 of the second body 16 is disposed and sealed within the interior chamber 32A of the package 32. The package 32 can be sealed by any suitable means. The sealed package 32 can easily be torn for removal of the folded sheet 19 when desired.

The second securing means 18 of the bib assembly 10 includes the lower edge portion 12B of the first body 12 being folded onto itself and sealed to itself at opposite ends 12D thereof such that a cuff 34 is formed along the lower edge portion 12B of the first body 12 having a top opening 34A facing upwardly therefrom. The second body 16 of the bib assembly 10 is substantially disposed within the cuff 34 through the top opening 34A thereof. The second body 16 can be releasably attached, such as by a rubber adhesive or the like, to a front side of the cuff 34 such that the second body 16 assists in keeping the cuff 34 open along the extent of the top opening 34A so as to enable the cuff 34 to catch debris dropped downward on the first body 12.

Alternatively, the lower edge portion 12B of the first body 12 can be sealed to itself at a pair of spaced apart locations 36 on the cuff 34 spaced inwardly from the opposite ends 12D such that a pocket 38 is formed within the cuff 34, as represented by dashed lines 36 in FIG. 1. The pocket 38 is preferably centrally formed on the cuff 34; however, it may be formed at any other suitable location along the lower edge portion 12B of the first body 12. The second body 16 is removably disposed within the pocket 38 of the cuff 34 on the first body 12. The pocket 38 has a length substantially less than the length of the cuff 34 but greater than the length or width of the package 32. The height of the pocket 38 is the same as the height of the cuff 34. Alternatively, the pocket 38 could be provided anywhere on the first body 12.

It should be understood that the second sheet can take the form of a layer of material applied to the first sheet, or vice versa, by any suitable conventional method, such as by spraying.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A bib assembly, comprising:

(a) a first body comprised of a substantially flexible sheet-like material in a substantially unfolded condition;

(b) first means for removably securing said first body to a user such that said first body covers a front portion of the user below a mouth of the user for preventing debris dropped from an area adjacent to and including the mouth of the user from contacting the front portion of the user, said first securing means including a twist tie member comprised of a substantially twistable material and having a middle portion mounted to said first body and opposite end portions extending from opposite ends of said middle portion, said opposite end portions and said middle portion together for encircling a neck of the user, said opposite end portions being twistable around one another for securing said twist tie member around the neck of the user and thereby for securing said first body to the user;

(c) a second body separate from said first body and including a substantially flexible sheet of material in a substantially folded condition and adapted to be unfolded for use in wiping debris from hands and the area adjacent to and including the mouth of the user; and (d) second means for removably securing said second body to said first body;

(e) said first body having an upper edge portion with a central section thereof being folded onto and attached to itself so as to define a passageway extending along said central section of said upper edge portion of said first body and having open opposite ends, said middle portion of said twist tie member of said first securing means being received through and captured within said passageway of said first body such that said opposite end portions of said twist tie member extend from said open opposite ends of said passageway.

2. The assembly of claim 1 wherein said first body has an outer sheet for facing away from the front portion of the user and an inner sheet for facing toward the front portion of the user, said outer sheet being comprised of a substantially flexible absorbent material for absorbing liquid, said inner sheet being comprised of a substantially flexible impermeable material and being attached to said outer sheet for preventing liquid absorbed by said outer sheet from contacting the front portion of the user.

3. The assembly of claim 1 wherein said first body is comprised of a substantially flexible impermeable material.

4. The assembly of claim 1 wherein said first body is comprised of a substantially flexible absorbent material.

5. The assembly of claim 1 wherein:

said second body further includes a package comprised of a substantially flexible impermeable material and defining an interior chamber; and said sheet of material of said second body is premoistened, folded and disposed and sealed within said interior chamber of said package of said second body.

6. The assembly of claim 1 wherein said second securing means includes a lower edge portion of said first body being folded onto itself and sealed to itself at opposite ends thereof such that a cuff is formed along said lower edge portion of said first body having a top opening facing upwardly therefrom, said second body being substantially disposed within said cuff of said first body through said top opening thereof such that said second body assists in keeping said cuff open along said top opening thereof to catch debris dropped on said first body.

7. The assembly of claim 6 wherein said second body is releasably attached to a front side of said cuff.

8. The assembly of claim 6 wherein said lower edge portion is sealed to itself at a pair of spaced apart locations on said cuff such that a pocket is formed within said cuff, said second body being substantially disposed within said pocket of said cuff on said first body.

9. The assembly of claim 1 wherein said first body has an upper edge portion and said middle portion of said twist tie member of said first securing means is mounted to said upper edge portion of said first body.

10. The assembly of claim 1 wherein adjacent opposite ends of said passageway said first body has opposite upper corners folded over and attached to adjacent portions of said first body.

11. The assembly of claim 1 wherein:

said second body further includes a package comprised of a substantially flexible impermeable material and defining an interior chamber; and said sheet of material of said second body is premoistened, folded and disposed and sealed within said interior chamber of said package of said second body.

12. The assembly of claim 11 wherein said second securing means includes a lower edge portion of said first body being folded onto itself and sealed to itself at opposite ends thereof such that a cuff is formed along said lower edge portion of said first body having a top opening facing upwardly therefrom, said second body being substantially disposed within said cuff of said first body through said top opening thereof such that said second body assists in keeping said cuff open along said top opening thereof to catch debris dropped on said first body.

13. The assembly of claim 12 wherein said lower edge portion is sealed to itself at a pair of spaced apart locations on said cuff such that a pocket is formed within said cuff, said second body being substantially disposed within said pocket of said cuff on said first body.

14. The assembly of claim 1 wherein said second securing means includes a pocket formed on said first body and having a top opening facing upwardly therefrom with said second body being substantially disposed within said pocket through said top opening thereof.

15. The assembly of claim 14 wherein:

said second body further includes a package comprised of a substantially flexible impermeable material and defining an interior chamber; and said sheet of material of said second body is pre-moistened, folded and disposed and sealed within said interior chamber of said package of said second body.

16. A bib assembly, comprising:

(a) a first body comprised of a substantially flexible sheet-like material in a substantially unfolded condition;

(b) first means for removably securing said first body to a user such that said first body covers a front portion of the user below a mouth of the user for preventing debris dropped from an area adjacent to and including the mouth of the user from contacting the front portion of the user, said first securing means including a twist tie member comprised of a substantially twistable material and having a middle portion mounted to said first body and opposite end portions extending from opposite ends of said middle portion, said opposite end portions and said middle portion together for encircling a neck of the user, said opposite end portions being twistable around one another for securing said twist tie member around the neck of the user and thereby for securing said first body to the user;

(c) a second body separate from said first body and including a substantially flexible sheet of material in a substantially folded condition and adapted to be unfolded for use in wiping debris from hands and the area adjacent to and including the mouth of the user, said second body further including a package comprised of a substantially flexible impermeable material and defining an interior chamber, said sheet of material of said second body being pre-moistened, folded and disposed and sealed within said interior chamber of said package of said second body; and second means for removably securing said second body to, said first body, said second securing means including a lower edge portion of said first body being folded onto itself and sealed to itself at opposite ends thereof such that a cuff is formed along said lower edge portion of said first body having a top opening facing upwardly therefrom, said second body being substantially disposed within said cuff of said first body through said top opening thereof such that said second body assists in keeping said cuff open along said top opening thereof to catch debris dropped on said first body, said second body being releasably attached to a front side of said cuff.

17. A bib assembly, comprising:

(a) a first body comprised of a substantially flexible sheet-like material in a substantially unfolded condition;

(b) first means for removably securing said first body to a user such that said first body covers a front portion of the user below a mouth of the user for preventing debris dropped from an area adjacent to and including the mouth of the user from contacting the front portion of the user, said first securing means including a twist tie member comprised of a substantially twistable material and having a middle portion mounted to said first body and opposite end portions extending from opposite ends of said middle portion, said opposite end portions and said middle portion together for encircling a neck of the user, said opposite end portions being twistable around one another for securing said twist tie member around the neck of the user and thereby for securing said first body to the user;

(c) a second body separate from said first body and including a substantially flexible sheet of material in a substantially folded condition and adapted to be unfolded for use in wiping debris from hands and the area adjacent to and including the mouth of the user; and (d) second means for removably securing said second body to said first body, said second securing means including a pocket formed on said first body and having a top opening facing upwardly therefrom with said second body being substantially disposed within said pocket through said top opening thereof;

(e) said first body having an upper edge portion with a central, section thereof being folded onto and attached to itself so as to define a passageway extending along said central section of said upper edge portion of said first body and having open opposite ends, said middle portion of said twist tie member of said first securing means being received through and captured within said passageway such that said opposite end portions of said twist tie member extend from said open opposite ends of said passageway.

* * * * *